United States Patent [19]

Clements et al.

[11] Patent Number: 4,765,136

[45] Date of Patent: Aug. 23, 1988

[54] GAS TURBINE ENGINE AUGMENTOR

[75] Inventors: Thomas R. Clements, Stuart; James D. Blevins, Palm Beach Gardens, both of Fla.

[73] Assignee: United Technologies Corporation, Hartford, Conn.

[21] Appl. No.: 102,745

[22] Filed: Sep. 24, 1987

Related U.S. Application Data

[63] Continuation of Ser. No. 801,642, Nov. 25, 1985, abandoned.

[51] Int. Cl.[4] ..... F02C 1/00

[52] U.S. Cl. ..... 60/261; 60/749

[58] Field of Search ..... 60/261, 727, 734, 743, 60/749, 738, 750, 39.826

[56] References Cited

U.S. PATENT DOCUMENTS

| | | | |
|---|---|---|---|
| 2,368,179 | 1/1945 | Turpin . | |
| 2,517,015 | 8/1950 | Mock et al. . | |
| 2,529,506 | 11/1950 | Lloyd et al. . | |
| 2,918,794 | 12/1959 | Hurd | 60/749 |
| 2,920,445 | 1/1960 | Bailey | 60/39.826 |
| 2,925,716 | 2/1960 | Regan et al. | 60/749 |
| 3,030,773 | 4/1962 | Johnson . | |
| 3,151,453 | 10/1964 | Lefebvre et al. | 60/261 |
| 3,366,373 | 1/1968 | Reed . | |
| 3,540,216 | 10/1970 | Quillevere et al. | 60/749 |
| 3,587,232 | 6/1971 | Bryce | 60/261 |
| 3,618,318 | 11/1971 | Bryce | 60/749 |
| 3,701,255 | 10/1972 | Markowski | 60/261 |
| 3,732,059 | 5/1973 | Goodnight et al. | 60/749 |
| 3,800,530 | 4/1974 | Nash . | |
| 3,869,864 | 3/1975 | Bunn . | |
| 3,946,553 | 3/1976 | Roberts et al. . | |
| 3,999,378 | 12/1976 | Tatem, Jr. et al. | 60/749 |
| 4,062,182 | 12/1977 | Fehler et al. . | |

FOREIGN PATENT DOCUMENTS

| | | | |
|---|---|---|---|
| 2551500 | 3/1985 | France | 60/261 |
| 704468 | 2/1954 | United Kingdom | 51/1 |

*Primary Examiner*—Louis J. Casaregola
*Assistant Examiner*—Timothy S. Thorpe
*Attorney, Agent, or Firm*—Norman Friedland

[57] ABSTRACT

The pilot section of a flameholder of an augmentor for a gas turbine engine is modified to improve the ignition and stability characteristics by judiciously locating aperture(s) or slot(s) in the pilot section wherein their orientation is critical so as to create a vortical flow field.

5 Claims, 4 Drawing Sheets

GAS TURBINE ENGINE AUGMENTOR

This is a continuation of Ser. No. 801,642 filed Nov. 15, 1985, now abandoned.

TECHNICAL FIELD

This invention relates to gas turbine power plants with augmentors and more particularly to means for improving the ignition and stabilization characteristics of the augmentor.

BACKGROUND ART

As is well known, the augmentor comprises a well known flameholder consisting of a pilot section centrally supported in the housing of the augmentor and carries a plurality of radially extending gutters. A plurality of sprayrings upstream of the flameholder serves to judiciously inject fuel in the engine's exhaust to be entrained in and ignited in the aerodynamic wake of the flameholder. The pilot section is designed to provide a recirculation zone to stabilize the burning characterstics of the fuel so as to sustain combustion and to propagate the combustion around the perimeter of the flameholder The augmentor should be capable of actuation at any time within the flight envelope for the aircraft's mission. It has been known that under certain aircraft operating conditions ignition and/or sustained operation has not been successful.

The typical pilot section of the augmentor is either domed or "V" shaped and the apex faces the fuel being injected by the sprayring. After the fuel entrained air flows past the aft station of the pilot section, a portion of the fuel/air mixture migrates rearwardly relative to the flow of the engine's exhaust and recirculates inside the pilot section. The fuel entrained air is brought in close proximity to the igniter mounted in the pilot section. Unless the fuel/air mixture is within the proper proportions combustion will not ensue. It has been found that the mixture in the heretofore known designs has often been either too lean or too rich for ignition to ensue. Tests have shown that a pilot section incorporating this invention can accommodate operation over a much broader range of fuel-air mixture ratios at all operating conditions.

We have found that we can obviate the fuel/air mixture problem in the pilot section by locating an opening or slot for discretely flowing the fuel entrained air into the pilot section at a predetermined location and orientation relative to the igniter. In particular, in the dome-shaped (in cross section) pilot section the opening is located downstream of the leading edge of the flameholder but in proximity thereto. The opening is oriented so that its plane is in coincidence with the walls of the opening and is perpendicular to the engine centerline such that the flow admitted into the pilot section is tangential to the inner wall of the apex of the dome and spaced from the igniter so that the fuel/air mixture passes in proximity thereto. Tests have shown that a pilot section incorporating this invention forms a small recirculating zone adjacent the igniter and has proven to provide efficacious ignition characteristics.

By creating the circulating vortices described in the paragraphs above around the full circumference of the pilot section in accordance with this invention the stability of the pilot section can be improved. This invention contemplates, in addition to improving ignition, improving stability by locating openings as described above around the circumference of the pilot section in a plane perpendicular to the centerline of the pilot section. The openings are oriented such that the flow into the pilot section is introduced tangentially to the inside surface of the leading edge.

In certain heretofore known systems the augmentor incorporated a shroud surrounding the pilot section designed to profile the flow to achieve an improved aerodynamic recirculation zone. The shroud provided a flow path adjacent to the outer surface of the pilot section and directed the fuel entrained air in proximity to the aft end of the pilot section. Augmentors incorporating this design did not achieve the desired stability characteristics for all operating conditions.

DISCLOSURE OF INVENTION

An object of this invention is to provide improved ignition and stability characteristics of the pilot section of an augmentor of a gas turbine engine.

A feature of this invention is the judicious location of openings on the upstream end of the pilot section to introduce into the pilot zone a fuel/air mixture in close proximity of the igniter. The location and orientation of the opening is selected to create a vortical flow field adjacent the igniter.

An additional feature is to improve the overall stability characteristics of the pilot section by providing a plurality of openings judiciously located around the circumference of the pilot section.

Other features and advantages will be apparent from the specification and claims and from the accompanying drawings which illustrate an embodiment of the invention.

BEST MODE FOR CARRYING OUT THE INVENTION

While the invention in its preferred embodiment is described in connection with a U-shaped or domed pilot section, and as would be understood by one skilled in the art, this invention has utility for other configured augmentors. For the sake of convenience and simplicity only that portion of the augmentor that relates to the invention will be described, and for further details of the augmentor reference should be made to the F-100 engine manufactured by Pratt & Whitney Aircraft of United Technologies Corporation, and U.S. Pat. No. 4,423,595 assigned to the same assignee as this patent application both of which are incorporated herein by reference herein.

Figure 1:
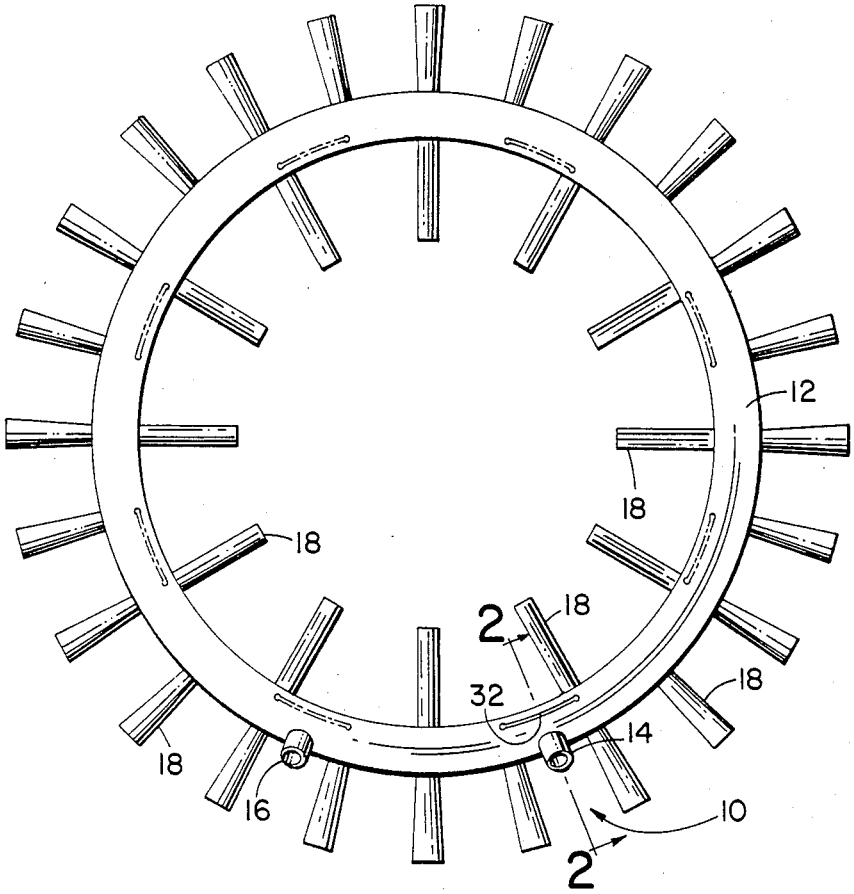
FIG. 1 is a elevated view of the flameholder of an augmentor for a gas turbine engine.
Figure 2:
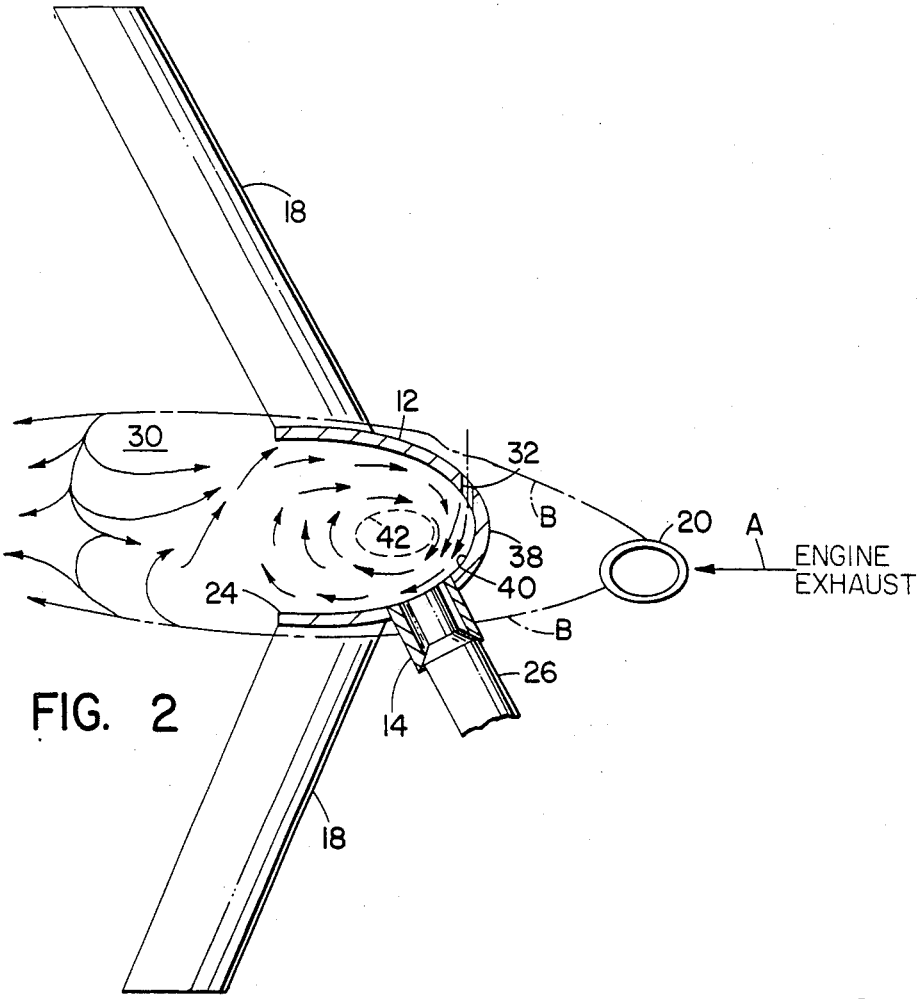
FIG. 2 is a sectional view taken along lines 2—2 of FIG. 1 and showing a typical fuel sprayring.
Figure 3:
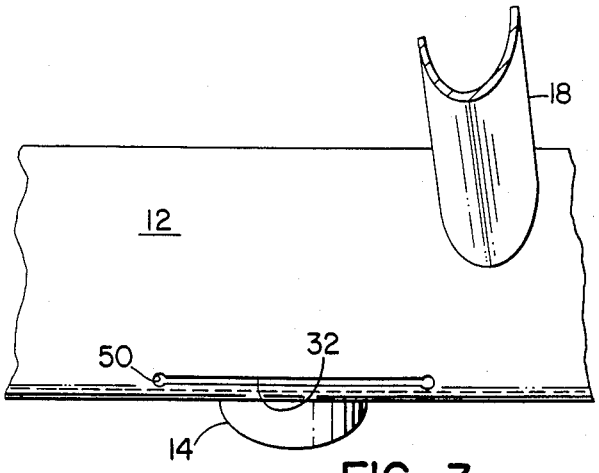
FIG. 3 is an enlarged partial plan view showing the invention.

As noted in FIGS. 1 to 3, the augmentor consists of a flameholder assembly generally indicated by reference numeral 10 having a pilot section 12, igniter ports 14 and 16 and a plurality of radial gutters 18 extending radially inwardly and outwardly and circumferentially spaced around the pilot section 12.

As best seen in FIG. 2, a suitable spray ring 20 injects fuel into the engine exhaust stream indicated by arrow A whereupon the exhaust entrained fuel is directed toward the pilot section 12 as shown by the stream lines indicated by arrow B. As the exhaust entrained fuel passes the aft station 24 of the pilot section 12 the pressure pattern will cause the flow to migrate toward the igniter 26 supported in the igniter ports 16 and 14. The resulting fuel/air mixture flows over the pilot section 12 and is entrained in the aerodynamic recirculation zone 30. The recirculation brings a portion of the fuel/air mixture into close proximity of the igniter 26 and is ignited when the igniter sparks. In some situations the fuel/air mixture reaching the igniter is too lean to be ignited.

According to this invention an aperture critically located and oriented in the pilot section 12 serves to improve the ignition and stability characteristics of the augmentor 10. In one embodiment as best seen in FIGS. 2 and 3 a slot 32 is formed in the wall of the pilot section extending transverse to the direction of the air flow in proximity to the leading edge 38 of the pilot section 12 so that the fore edge of slot is substantially in line with the inner surface 40 of the pilot section 12 on the back wall of leading edge 38. The slot is machined perpendicular to the engine centerline (parallel with the centerline of pilot section 12) so that it breaks through the inside surface of the pilot section 12 as nearly tangential to the surface 40 as possible.

In this configuration, exhaust entrained fuel is admitted through slot 32 whereupon a swirl is imparted thereto to form a vortical recirculating zone 42 in proximity to igniter 26. This enriches the fuel/air mixture and as is apparent no other complicated apparatus is necessary, as for example, a specialized spray bar configuration.

Figure 6:
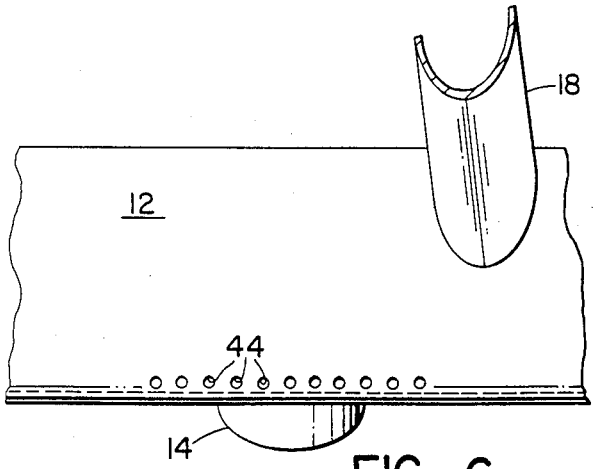
FIG. 6 is a partial view of the flameholder showing holes instead of slots as another embodiment of this invention.

Another embodiment to this invention is exemplified in FIG. 6 which shows a plurality of drilled holes 44 extending laterally relative to the exhaust flow. Likewise each hole is drilled perpendicular to the engine centerline and in proximity to the inside wall 40 of leading edge 38. In either configuration the critical location and orientation is designed to produce a vortical recirculation zone adjacent the igniter.

When utilizing the slot configuration as shown in FIGS. 1 to 3, it is preferred to incorporate some means for preventing the initiation of cracks. A suitable means would be by putting a sufficient radius 50 at the ends of the slot or "stop drilled".

As is exemplified in FIG. 1, a plurality of slots 32 (or drilled holes 44) may be located around the circumference of the pilot section 12 to enhance combustion stability. The ingestion of fuel/rich gas through these slots 32 or holes 44 so as to provide a plurality of the vortices (zone 42) would improve stability. The number of slots and the spacings would depend on the particular application for each augmentor.

Actual tests of the present invention in comparison with a shrouded pilot utilized in heretofore known augmentors have shown that the flameholder with the invention operates over a wider range of fuel/air ratios and altitude than a flameholder without the invention. These comparisons are illustrated in FIG. 4 comparing the ignition characteristics and FIG. 5 comparing the stability envelope characteristics.

Figure 4:
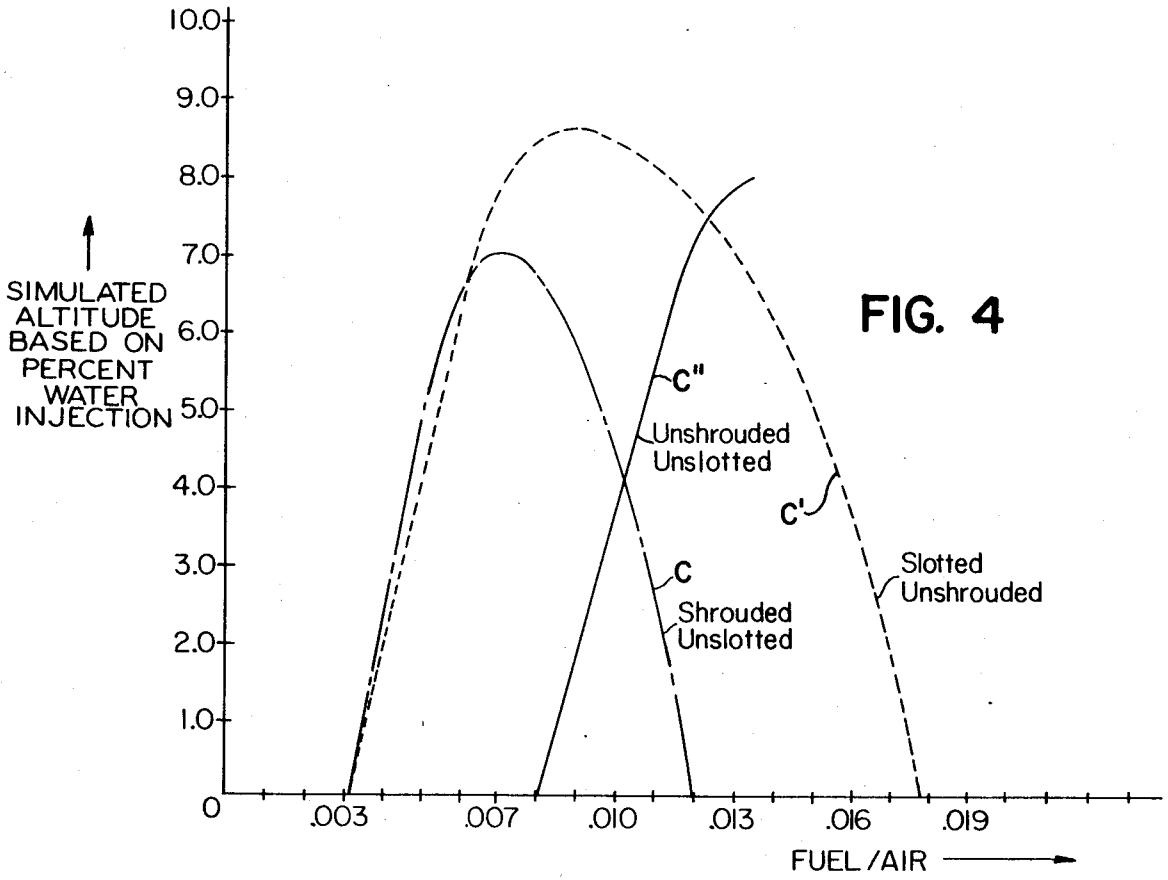
FIG. 4 is a graphical illustration showing the documented improvement in ignition capability effected by the present invention.

In FIG. 4 the curve represented by the dash line C shows the range of where ignition will ensue over a given fuel air ratio for a given altitude for the shrouded pilot. Line C' shows the expanded range for ignition when the invention is employed. While the shrouded pilot gives similar results at the low end of the scale, flameholders without the shroud have not evidenced these results as shown by line C''. Hence, the flameholder utilized in the invention produces similar results in the low portion of the lean fuel/air ratio without the encumbering hardware represented by the shroud while greatly extending the rich fuel/air and altitude ignition capability.

Figure 5:
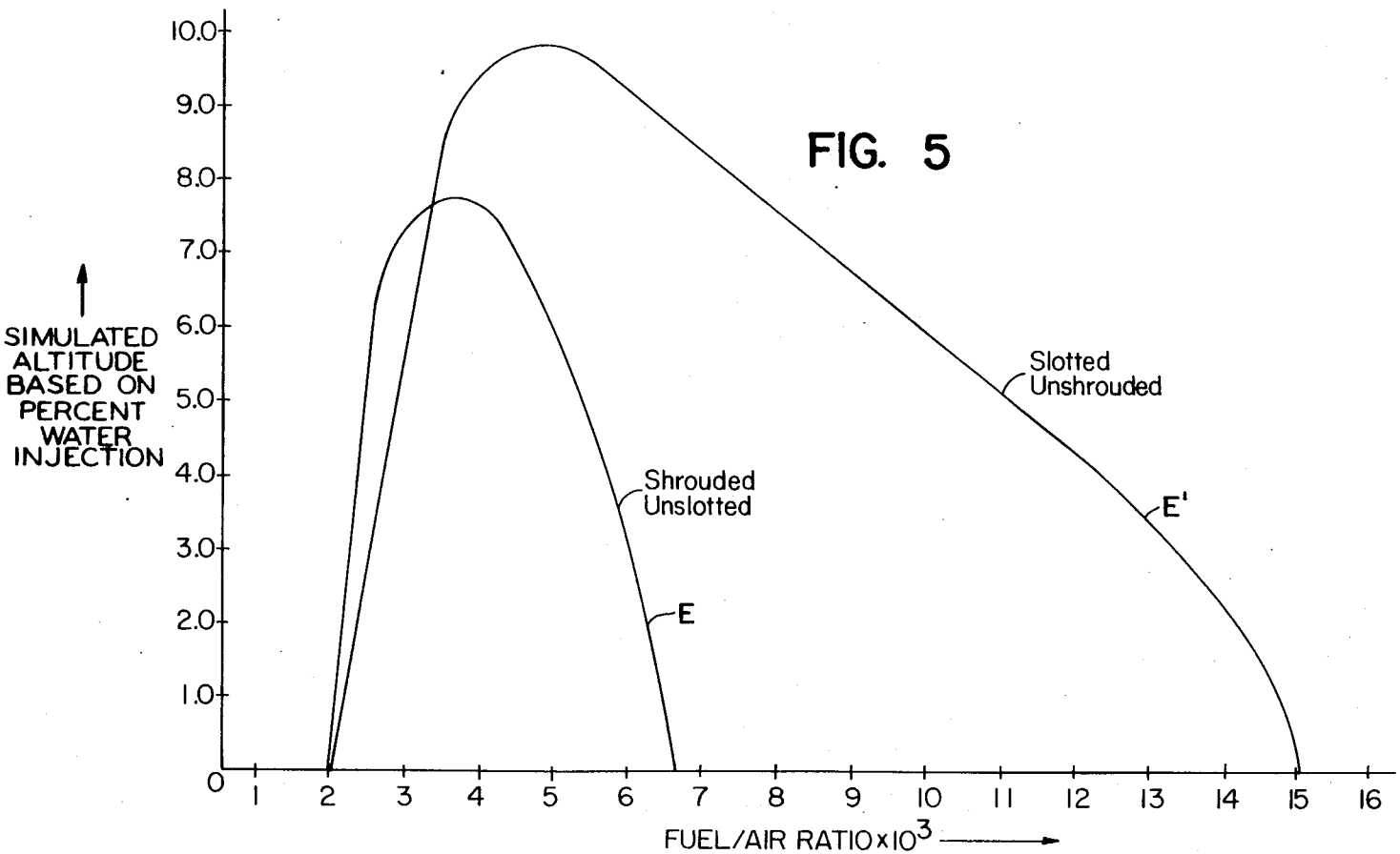
FIG. 5 is a graphical illustration showing the results of tests in improving the stability envelope of the present invention with a typical pilot section in actual use.

FIG. 5 is actual test data comparing the stability characteristics of the shrouded pilot flameholer and of the flameholder incorporating the invention. Line E illustrates the stability regime of the shrouded pilot flameholder and Line E' is that for the flameholer incorporating the invention. Stability will be evidenced under all the fuel/air ratio values for a given altitude while the augmentor is operating under the respective curves.

Again, the flameholder incorporating the invention has a much extended range of operation both in terms of acceptable fuel/air ratios and in terms of altitude capability.

It should be understood that the invention is not limited to the particular embodiments shown and described herein, but that various changes and modifications may be made without departing from the spirit and scope of this novel concept as defined by the following claims.

We claim:

1. An annular-shaped pilot section for a flameholder disposed in the augmentor of a gas turbine engine and said pilot section having a generally parabolic-shaped wall means defining a cavity, said parabolic-shaped wall means having a closed end portion at the fore end defining a leading edge having a generally concaved-shaped surface defining a portion of said cavity and an opened portion at the aft end for admitting fuel entrained exhaust gases, said augmentor having an axially extending centerline and said annular-shaped pilot section having a centerline in coincidence with said centerline of said augmentor, said fore end and said aft end being relative to the flow of the gas path in said gas turbine engine and an igniter disposed in said cavity, wherein the improvement comprises a slot in said wall means extending transverse to the direction of the flow of exhaust from said gas turbine engine, and being located adjacent said leading edge, said slot being oriented perpendicular to the centerline of said annular-shaped pilot section and said slot is disposed a distance from said igniter wherein the flow of fuel enriched engine exhaust gases flowing through said slot is directed tangentially relative to said concave-shaped surface to create a vortical flow region, and said vortical flow region is located adjacent said igniter.

2. An annular-shaped pilot section as in claim 1 wherein the flameholder includes a plurality of radially extending gutters circumferentially spaced around said pilot section wherein the improvement comprises having said slot extending between two adjacent gutters of said plurality of gutters.

3. An annular-shaped pilot section as in claim 2 wherein said aperture is a drilled hole and a plurality of drilled holes identically oriented relative to said leading edge are circumferentially spaced about said parabolic-shaped wall means.

4. An annular-shaped pilot section as in claim 2 wherien the improvement includes a plurality of additional slots identically oriented as said slot adjacent said igniter, said plurality of additional slots circumferentially spaced around said pilot section, each of said plurality of additional slots being dimensioned so that its lateral extent is not greater than the spacing between adjacent gutters and each of said plurality of additional slots being disposed between adjacent gutters whereby the stability characteristic of said pilot section is enhanced.

5. An annular-shaped pilot section as in claim 1 wherein said slot is comprised of spaced holes extending in a plane a predetermined distance.

* * * * *

UNITED STATES PATENT AND TRADEMARK OFFICE

CERTIFICATE OF CORRECTION

PATENT NO. : 4,765,136

DATED : August 23, 1988

INVENTOR(S) : Thomas R. Clements et al

It is certified that error appears in the above-identified patent and that said Letters Patent is hereby corrected as shown below:

Column 1, line 57: After "wall", change "of" to --at--

Column 4, line 46: After "augmentor," omit the words --said fore end and said aft end being relative to the flow of the gas path in said gas turbine engine--

Column 4, line 17: Change "flameholer" to --flameholder--

Column 4, line 20: Change "flameholer" to --flameholder--

Signed and Sealed this

Seventeenth Day of January, 1989

*Attest:*

DONALD J. QUIGG

*Attesting Officer*

*Commissioner of Patents and Trademarks*